US005846099A

United States Patent [19]

Hiruma et al.

[11] Patent Number: 5,846,099

[45] Date of Patent: Dec. 8, 1998

[54] CONNECTOR DEVICE WITH OVERVOLTAGE PROTECTION

[75] Inventors: Yoshimasa Hiruma; Kazuyuki Shimizu, both of Tokyo, Japan

[73] Assignee: Goh Shoji Co., Inc., Tokyo, Japan

[21] Appl. No.: 848,314

[22] Filed: Apr. 30, 1997

[30] Foreign Application Priority Data

May 9, 1996 [JP] Japan ..... 8-114971
Jul. 12, 1996 [JP] Japan ..... 8-183745

[51] Int. Cl.[6] ..... H01R 13/66

[52] U.S. Cl. ..... 439/620; 439/418

[58] Field of Search ..... 439/620, 418, 439/676

[56] References Cited

U.S. PATENT DOCUMENTS

| | | | |
|---|---|---|---|
| 4,522,455 | 6/1985 | Johnson | 439/92 |
| 5,297,015 | 3/1994 | Miyazaki et al. | 439/489 |
| 5,306,180 | 4/1994 | Buhr | 439/620 |
| 5,631,806 | 5/1997 | Fried et al. | 439/874 |

*Primary Examiner*—Gary F. Paumen
*Attorney, Agent, or Firm*—Frishauf, Holtz, Goodman, Langer & Chick

[57] ABSTRACT

A connector device includes a main body having a plug section. The main body accommodates therein two contact members, a bidirectional diode-thyristor, and a distal end portion of a signal-transmission cable connected with an external electronic equipment. The two contact members are connected with two terminals of the thyristor and two conductor wires of the signal-transmission cable, to thereby obtain a modular plug with overvoltage protection. By inserting the modular plug into a modular jack, the external electronic equipment is connected with a communication line. If an overvoltage is applied to the communication line, the thyristor is rendered conductive to absorb the overvoltage, so that the electronic equipment is protected from the overvoltage. In place of designing the connector plug to hold the distal end portion of the signal-transmission cable, the connector body may be formed with a socket section which receives an external modular plug, to thereby obtain a modular adapter with overvoltage protection which is used to connecting a modular plug with a modular jack.

19 Claims, 8 Drawing Sheets

CONNECTOR DEVICE WITH OVERVOLTAGE PROTECTION

BACKGROUND OF THE INVENTION

1. Field of the Invention

The present invention relates to a connector device for connecting a data processing device or communication equipment to a communication line and, more particularly, to a connector plug having an overvoltage protection function and adapted to be inserted into a connector socket, and to an adapter having an overvoltage protection function and used to connect a connector plug with a connector socket.

2. Related Arts

In recent years, information communication technologies using communication lines such as public telephone lines have been developed. This development permits easy access to a large-scale database through communication lines from personal computers equipped in offices and homes, and permits network services to exchange information between personal computers through telephone lines, for instance.

The communication lines of this type extend in every sphere of an urban area and also extend between city areas. An individual communication line is led into an office or home and is connected through interior wiring with a data processing device, including a computer, or communication equipment including a telephone set, facsimile, modem. Hereinafter, the data processing device, communication equipment, etc. are collectively referred to as electronic devices or electronic equipment. Recently, connectors of a modular type (modular plug and modular jack) have been used widely. By inserting a modular plug, connected with a signal-transmission cable extending from electronic equipment, into a modular jack connected with the interior wiring, the electronic equipment can be connected easily to the communication line.

If an excessive voltage caused by inductive lightning is applied to communication lines extending in an area where lightning occurs, a surge voltage is applied to electronic devices connected with these communication lines. This sometimes leads to damage to electronic devices and destruction of data.

Conventionally, to protect an electronic device from a surge voltage, an overvoltage protection circuit which absorbs the surge voltage is incorporated into a protector which is provided in a lead-in port for the communication line in an office or home, to thereby prevent the application of the surge voltage to an electronic device. The overvoltage protection circuit, which is usually comprised of a surge protection element such as an arrester, including a gas-tube arrester, or a zinc oxide varistor, is connected between a pair of signal lines of the communication line. Sometimes, multi-stage protection is afforded by a protection circuit provided with a gas-tube arrester and a zinc oxide varistor which are arranged in two stages, or by further inserting a diode bridge circuit at the later stage of the protection circuit.

However, these surge protection elements for the overvoltage protection circuit have their characteristics which change with time by the repetitive application of impulse current thereto. In addition, it is generally difficult to see to what degree the surge protection device has deteriorated in its characteristics. For this reason, the electronic device cannot be sufficiently protected from overvoltage by the protector provided with such an overvoltage protection circuit. Moreover, the protector equipped with the overvoltage protection circuit of this type must be maintained by a qualified electric worker, so that the maintenance and modification of the protector cannot be carried out by the user. Therefore, the user cannot take any measures although knowing that the surge voltage caused by inductive lightning may adversely affect electronic equipment.

SUMMARY OF THE INVENTION

An object of the present invention is to provide a connector device with overvoltage protection, which can easily and effectively protect electronic equipment, including communication equipment and a data processing device, from an overvoltage caused by inductive lightning etc. and applied via a communication line.

Another object of the present invention is to provide a connector device with overvoltage protection, which is easy in assembly, excellent in mass productivity, and therefore less costly to manufacture.

Still another object of the present invention is to provide a connector device with overvoltage protection, which is suitable for use as an adapter used to connect a plug with a socket, especially, as a modular adapter for establishing connection between a modular plug and a modular jack.

The connector device with overvoltage protection according to the present invention comprises a main body having a plug section adapted to be detachably inserted into an external connector socket which has two socket contacts electrically connected individually to two conductor wires of a first signal-transmission cable; two first contact members disposed in the plug section, these two first contact members being electrically connected individually to the two socket contacts when the plug section is inserted into the external connector socket; and an overvoltage absorption solid-state device disposed in the main body and having two terminals which are electrically connected individually to the two first contact members. The two first contact members are connected or adapted to be connected respectively to two conductor wires of a second signal-transmission cable which is connected or adapted to be connected with external electronic equipment.

According to the connector device, having the overvoltage absorption solid-state device, of this invention, external electronic equipment including a data processing device, communication equipment, etc. can be effectively protected from overvoltage by connecting the electronic equipment to a communication line via the connector device. Moreover, by using the connector device in place of an existing connector device, the protection against overvoltage applied from the outside can be achieved by the user, without the need of modifying electrical equipment and its component parts such as a protector whose maintenance, check, etc. should be made by a qualified electric worker. As a result, the electronic equipment can be protected effectively from a surge voltage caused by inductive lightning or the like. Since a solid-state device is used for overvoltage absorption, the connector device can be made compact in size, so that it is suitable for use as a modular plug or a modular adapter.

Preferably, the overvoltage absorption solid-state device is comprised of a silicon bidirectional diode-thyristor. With this arrangement, the overvoltage absorption solid-state device can be made compact, and the protection against overvoltage can be provided with high reliability.

This connector device can be embodied as a connector plug (more specifically, a connector plug with or without a second signal-transmission cable). In this case, preferably, the main body is formed with a cable accommodation space for accommodating therein one end portion of the second signal-transmission cable.

Each of the two conductor wires of the second signal-transmission cable is formed by a sheathed conductor wire consisting of a conductor and an insulator which covers the conductor or formed by a bare conductor wire consisting of a conductor.

In the case of the connector device of a type having a second signal-transmission cable, that is, a second signal-transmission cable is included in the connector-device as a device component, the plug section of the main body of the connector device is adapted to be detachably inserted into a modular jack which serves as an external connector socket, and a modular cable is used as the second signal-transmission cable, whereby the connector device suitable for use as a modular plug can be provided.

Preferably, each of the first contact members is disposed in contact with an associated one conductor of the conductor wires of the second signal-transmission cable. More preferably, each of the first contact members has a contact pin which is disposed in contact with the conductor. In case that the second signal-transmission cable has sheathed conductor wires, the contact pin breaks the insulator and comes in contact with the conductor. With this arrangement, the electrical connection between the first contact members and the second signal-transmission cable can be made surely.

The second signal-transmission cable may have a sheath for sheathing the two conductor wires. In this case, preferably, the cable accommodation space has a first space section which is open to that end face of the main body which is disposed on a side remote from the plug section and accommodates therein the second signal-transmission cable with the sheath and a second space section which communicates with the first space section and accommodates therein the second signal-transmission cable with the sheath stripped. This preferred embodiment enables the main body of the connector device to surely hold the second signal-transmission cable, and is convenient for establishing the electrical connection between the second signal-transmission cable and the first contact members.

Preferably, the plug section of the main body is formed with two grooves. Each of these grooves accommodates therein an associated one of the two first contact members. With this arrangement, the first contact members can be positioned in their places in the main body. More preferably, the two first contact members are arranged adjacently to the overvoltage absorption solid-state device. Each of the first contact members has a portion thereof disposed in contact with a corresponding one of the two terminals of the overvoltage absorption solid-state device at the outside of the two grooves. With this arrangement, the electrical connection between component parts of the connector device and the assembly of the connector device are made easy.

Preferably, the main body is formed with a recess accommodating therein the overvoltage absorption solid-state device. The two terminals of the overvoltage absorption solid-state device are exposed from an outer face of the solid-state device. The connector device further includes a pair of wiring members. At least part of each of the wiring members is disposed in the recess of the main body. Each of the wiring members has a first end thereof electrically connected with an associated one of the two conductor wires of the second signal-transmission cable, a second end thereof disposed in contact with an associated one of the two first contact members, and an intermediate portion thereof disposed in contact with an associated one of the two terminals of the overvoltage absorption solid-state device. With this arrangement, the connection between the first contact members of the connector device and the second signal-transmission cable and the connection between the first contact members and the overvoltage absorption device can be made easily with the aid of the wiring members, whereby the assembly of the connector device is made easy.

The two conductor wires of the second signal-transmission cable may be comprised of bare conductor wires. In this case, preferably, the cable accommodation space communicates with the recess. The two bare conductor wires of the second signal-transmission cable protrude from the cable accommodation space into the recess. The first end of each wiring member is disposed in contact with an associated one of those two bare conductor wires of the second signal-transmission cable which protrude into the recess. According to this preferred embodiment, the electrical connection between the wiring members and the first contact members can be established easily, and the assembly of the connector device can be carried out more easily.

Preferably, the recess has an opening which opens to one of those external surfaces of the main body which extend in a longitudinal direction of the main body. The wiring members are disposed in the recess on a side remote from the opening of the recess, as viewed in a height direction of the main body. The overvoltage absorption solid-state device is disposed adjacently to the wiring members in the recess, as viewed in the height direction of the main body. The connector device further includes a lid member which closes at least part of the opening of the recess. The lid member cooperates with the main body to hold the wiring members, the overvoltage absorption solid-state device, and the two first contact members. According to this preferred embodiment, the assembly of the connector device and the electrical connection between device component parts are made more easy.

More preferably, the plug section of the main body is formed with two grooves. The recess is adjacent to the plug section in the longitudinal direction of the main body and communicates with the two grooves of the plug section. Each of the grooves accommodates therein an associated one of the two first contact members and part of an associated one of the wiring members. The lid member has a longitudinal lid section thereof extending in the longitudinal direction of the main body along the opening of the recess, and a vertical lid section thereof extending in the height direction of the main body between the overvoltage absorption solid-state device and the two first contact members. The main body has a wall thereof disposed on the side remote from the opening of the recess, as viewed in the longitudinal direction of the main body. The wall cooperates with the plug section to define the recess, and cooperates with the longitudinal lid section of the lid member to hold the wiring members and the overvoltage absorption solid-state device. The plug section cooperates with the vertical lid section of the lid member to hold the two first contact members. Preferably, each of the first contact members is formed at its opposite edges with one or more engagement projections or engagement recesses. Each of said plug section and said vertical lid section is formed with one or more engagement recesses or engagement projections with which said associated one or more engagement projections or engagement recesses engage.

According to these preferred embodiments, the electrical connection between device component parts is made reliable by the mechanical contact/engagement structure of the connector device without the need of processing such as soldering, and the connector device can be made very strong in structure.

The present invention can be applied to a connector device connected with an external signal-transmission cable. That is, according to another embodiment of the present invention different from the embodiments having the main body formed with the cable accommodation space, the main body is formed with a socket section which is adapted to detachably receive an external connector plug, the external connector plug having two plug contacts electrically connected individually to the two conductor wires of the second signal-transmission cable. The connector device further includes two second contact members disposed in the socket section. These two second contact members are electrically connected with the two first contact members, respectively. The two second contact members are electrically connected with the two plug contacts, respectively, when the external connector plug is inserted into the socket section. With this arrangement, the connector device is provided which is suitable for use as an adapter interposed between the connector plug and the connector socket for establishing connection therebetween. By interposing this adapter between the existing connector plug and the existing connector socket, overvoltage protection can be achieved.

In the case of the adapter which is interposed between a modular plug and a modular jack, the external connector socket is the modular jack, and the external connector plug is the modular plug, and the socket section is adapted to detachably receive the modular plug.

Like the preferred embodiments suitable for use as a connector plug, in the preferred embodiment suitable for use as an adapter, a pair of wiring members may be arranged in the recess of the main body of the connector device, whereby the assembly of the connector device is made easy.

Preferably, the recess communicates with the socket section. Each of the second contact members is formed integrally with an associated one of the wiring members. With this arrangement, the assembly of the connector device is made more easy.

Like the preferred embodiments suitable for use as a connector plug, in the preferred embodiment which includes the wiring members formed integrally with the second contact members, a lid member for holding the wiring members, overvoltage absorption solid-state device, and first contact members may be provided, so as to permit more easy assembly of the connector device.

DETAILED DESCRIPTION OF PREFERRED EMBODIMENTS

With reference to the drawings, connector devices with overvoltage protection according to several preferred embodiments of the present invention will be described.

Figure 1:
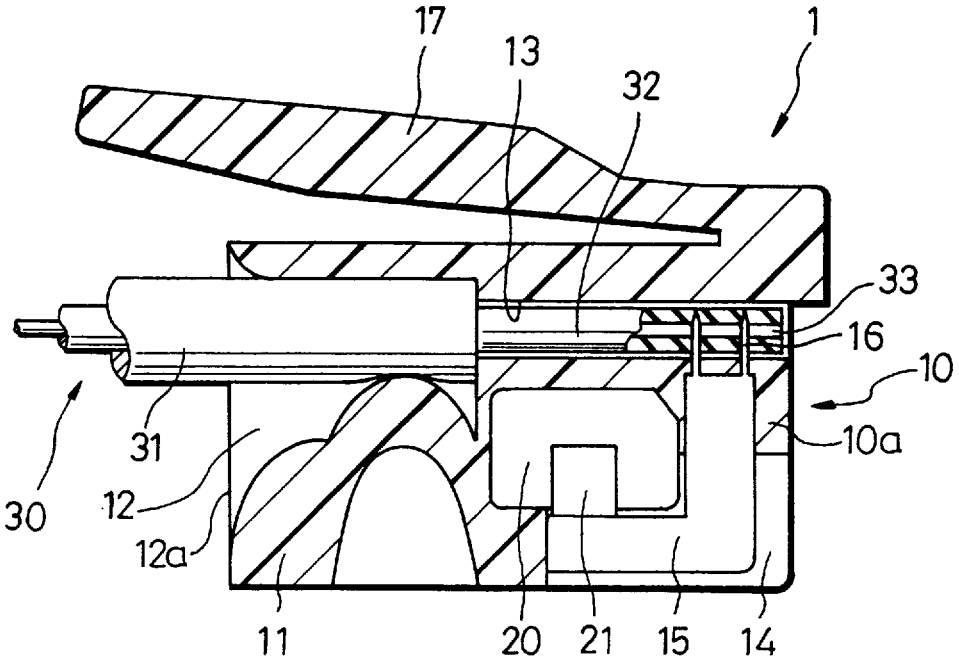
FIG. 1 is a longitudinal sectional view showing a modular plug with overvoltage protection according to a first embodiment of the present invention.

First, a connector device according to a first embodiment of the present invention will be described, which device is suitable for use as a modular plug with overvoltage protection (hereinafter referred to as plug). Referring to FIG. 1, the plug 1 has a plug body 10 made of a material consisting mainly of polycarbonate, for instance.

The plug body 10 has dimensions and shape conforming to the FCC (Federal Communications Comm) standard, and is detachably plugged in an external modular socket (hereinafter referred to as socket) which is disposed on, e.g., the wall surface of a house and paired with the plug. The socket is configured in the same way as a modular socket (modular jack) shown by reference numeral 40 in FIG. 14. The socket 40 has, e.g., two socket contacts 41, electrically connected individually to, e.g., two conductor wires 71 of a first signal-transmission cable led in an indoor space, such as for example a public telephone line 70.

As shown in FIG. 1, the plug body 10 is formed, as a whole, into a rectangular parallelepiped shape, is provided at its front side with a plug section 10*a* adapted to be detachably inserted into the socket 40, and is provided at its rear side with a cable accommodation space 12, 13 which is adapted to receive one end portion of a second signal-transmission cable 30. The second signal-transmission cable 30 has, e.g., two conductor wires 33 each consisting of a conductor wire 33 and an inner sheath 32 which covers the wire 33. The two sheathed conductor wires 32, 33 are covered with an outer sheath 31. The second signal-transmission cable 30 is preferably comprised of a modular cable, and has another end thereof connected with, e.g., a conventionally known modular plug. The plug is inserted into a modular jack provided on external electronic equipment such as a data processing device or communication equipment, not shown.

The cable accommodation space consists of a first space section 12 for accommodating therein the second signal-transmission cable 30 with the outer sheath and an insertion hole 13 (a second space section) for accommodating therein the second signal-transmission cable 30 with the outer sheath stripped (i.e., sheathed conductor wire 32, 33). These two space sections 12 and 13 communicate to each other, and extend in the longitudinal direction of the plug body 10. The first space section 12 is open to the rear end face of the plug body 10. Reference numeral 12a denotes the opening of the first space section 12.

At the front end of the plug body 10, a lever 17 is provided integrally with the upper wall of the plug body. Specifically, the lever 17 is hinge-connected with the plug body 10, and is adapted to be pivoted around the hinge-connected portion in the directions toward and away from the plug body 10. At opposite edges of a longitudinal intermediate portion of the lever 17, shoulders (not shown) are provided which protrude outward in the width direction of the lever 17.

The plug body 10 accommodates therein a silicon bidirectional diode-thyristor (more generally, an overvoltage absorption solid-state device), which is a principal element of the modular plug 1. Two terminals 21 of the thyristor 20 are exposed on the bottom surface of the thyristor 20. The thyristor 20 can be configured by a current type silicon surge-protective device (CSSPD), which is available from, for example, Shindengen Kogyo in Japan.

In order to arrange the thyristor 20 in the plug body 10 as illustrated, an upper half of the plug body 10 and a lower half thereof formed with a thyristor accommodation recess are molded separately, and these halves are joined to each other after the thyristor 20 is put into the recess of the lower half of the plug body, for instance. Alternatively, so-called insert molding may be performed in which the plug body is molded, with the thyristor 20 disposed in a mold for plug body molding.

Figure 2:
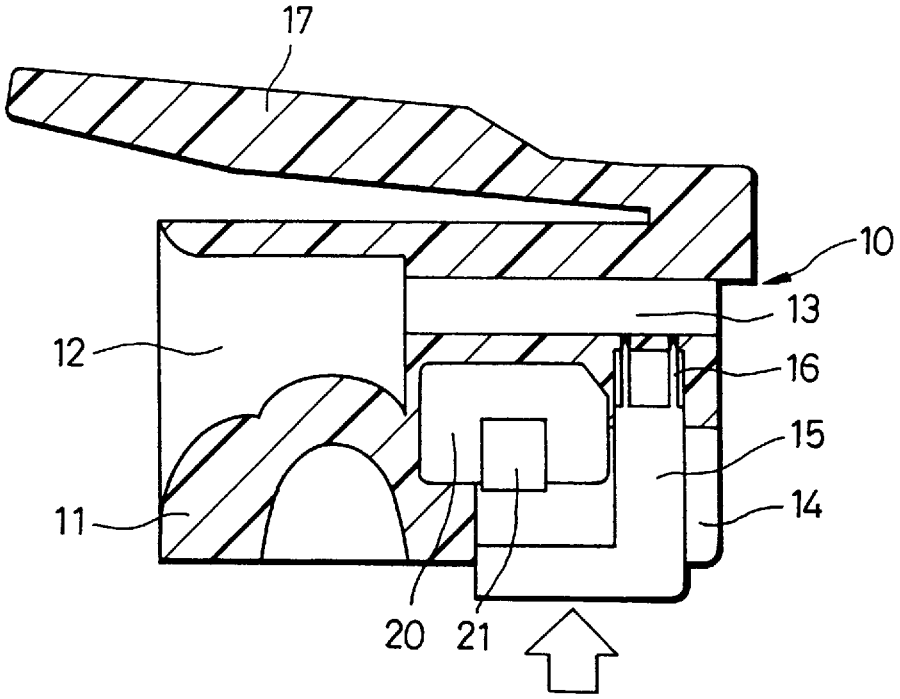
FIG. 2 is a sectional view showing an assembly process for the modular plug shown in FIG. 1.

The plug section 10*a* is provided with two or more contact grooves 14. L-shaped connection contact plates (first contact members) 15 are pressed into, e.g., two of these contact grooves 14, respectively, as shown in FIG. 2. Each contact plate 15 has a horizontal portion thereof extending in the longitudinal direction of the plug body 10 and a vertical portion thereof extending in the height direction of the plug body 10. Two needle-shaped contact pins 16 are formed at the upper end of the vertical portion. Each contact plate 15 is in contact at its contact pins 16 with the associated conductor wire 33 of the second signal-transmission cable 30 so as to be electrically connected therewith, and is in contact at the upper surface of the horizontal portion with the corresponding exposed terminal 21 of the thyristor 20 to establish electrical connection therewith. At least part of the outer surface of the front and lower edges of the contact plate 15 is exposed to the outside of the contact groove 14. When the plug section 10*a* is inserted into the socket 40, the exposed outer surface of the contact plate 15 is brought into contact with the socket contact 41 at the outside of the contact groove 14, so that electrical connection therebetween is established.

In assembling the modular plug 1 configured as described above, a predetermined length, which is substantially equal to the length of the insertion hole 13, of the outer insulator 31 of the second signal-transmission cable 30 is removed. Then, the two sheathed signal lines 32, 33 are inserted into the insertion hole 13 (second space section) from the first space section 12 of the cable accommodation space, as shown in FIG. 1. As a result, the sheathed conductor wires 32, 33 at the distal end portion of the second signal-transmission cable 30 are arranged in the second space section 13, and those portions 31, 32, and 33 which are covered by the outer insulator at the distal end portion of the cable are arranged in the first space section 12.

Next, the two contact plates 15 are pressed into the contact grooves 14 toward the insertion hole 13 by using an FCC standard hand tool (not shown). The contact pins 16 of each contact plate 15 break the inner insulator 32 of the associated second signal-transmission cable and come in contact with the associated signal line 33. At this time, the horizontal portion of each contact plate 15 comes in contact with the associated terminal 21 of the thyristor 20 incorporated in the plug body 10. Thus, electrical connection is established between the contact plate 15 and the signal line 33 and between the contact plate 15 and the thyristor terminal 21. As a result, the thyristor 20 is interposed between two contact plates 15 and, in turn, between two signal lines 33.

In the meantime, it is not essential to make the press-fitting of the connection contact plate 15 in order to establish the connection between the contact plate 15 and the thyristor terminal 21. Alternatively, the contact plate 15 and the thyristor terminal 21 may be connected in advance by means of a lead wire, bonding wire, etc.

Next, the bottom wall 11 of the plug body 10 is deformed by heating from the state shown in FIG. 2 to the state shown in FIG. 1, so that the distal end portion of the signal-transmission cable 30 covered with the sheath 31 is pressed on the inner surface of upper wall of the plug body 10 whereby the distal end portion of the signal-transmission cable 30 is held in the plug body 10.

By connecting the thus assembled modular plug 1 with the modular socket 40, electronic equipment such as a data processing device can be connected with the telephone line. On this occasion, when the plug section 10*a* of the plug 1 is inserted into the socket 40, the shoulders of the lever 17 are pressed down toward the plug body 10 by protrusions (denoted by reference numeral 40*a* in FIG. 14) formed on the inner surface of the upper wall of the socket. When the plug section 10*a* is further pushed into the socket 40 so that the shoulders of the lever 17 pass the protrusions 40*a*, the lever 17 is restored by its own elasticity in the direction away from the plug body 10. The rear end faces of the shoulders of the lever 17 engage with the end face of the protrusions 40*a*, so that the plug 1 is connected with the socket 40 so as not to be removed therefrom. When the plug 1 is to be removed from the socket 40, the plug is pulled out of the socket with the lever 17 being pressed down.

The following is a description of the silicon bidirectional diode-thyristor 20 incorporated, as an overvoltage absorption solid-state device, in the modular plug body 10

Figure 3:
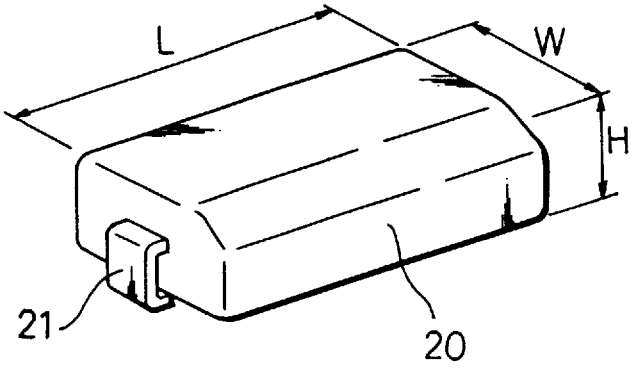
FIG. 3 is a perspective view showing a silicon bidirectional diode-thyristor incorporated in the modular plug shown in FIG. 1.
Figure 4:
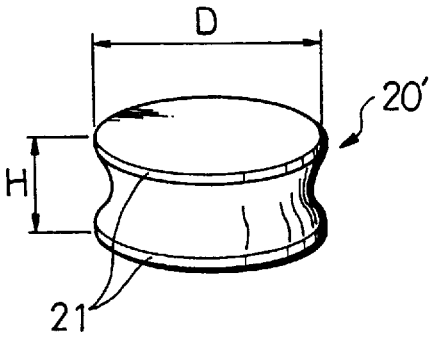
FIG. 4 is a perspective view showing a modification of the bidirectional diode-thyristor.

In this embodiment, a surface-mount-packaged thyristor 20 is used, which is shown by way of example in FIG. 3. This thyristor 20 has, for example, a length L of 7.6 mm, a width W of 4 mm, and a height H of 2.8 mm. In place of this, a button-packaged thyristor 20' may be used. This thyristor 20' has, for example, a diameter D of 4.15 mm and a height H of 1.7 mm.

Figure 5:
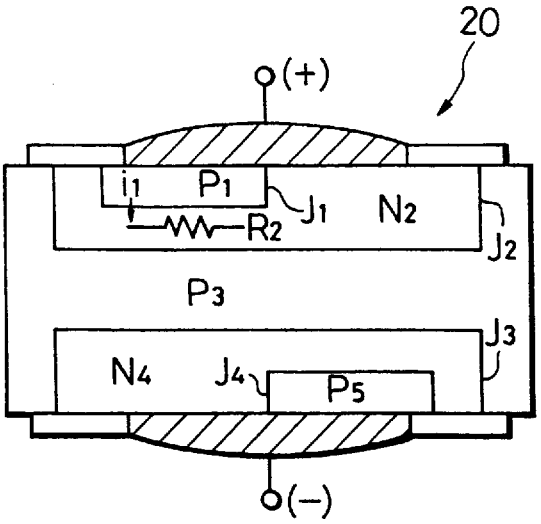
FIG. 5 is a view showing a device construction of the bidirectional diode-thyristor shown in FIG. 1.
Figure 6:
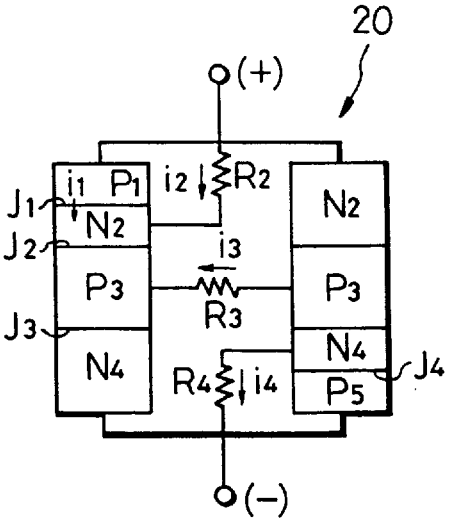
FIG. 6 is a view showing an electrically equivalent circuit of the thyristor shown in FIG. 5.

The overvoltage absorption solid-state device of this embodiment is a bidirectional thyristor having a planar type 5-layer construction shown in FIG. 5 without a gate electrode, and is manufactured by using a silicon base material. This silicon bidirectional diode-thyristor 20 is equivalent to two thyristors connected in inverse parallel with each other, as shown in FIG. 6. In other words, In place of the bidirectional diode-thyristor 20, an overvoltage absorption solid-state device consisting of two thyristors etc. can be used.

In FIGS. 5 and 6, symbols P1, N2, P3, N4 and P5 indicate five layers of the thyristor 20, and symbols $J_1$, $J_2$, $J_3$ and $J_4$ indicate four junctions of the thyristor 20. Symbols $i_1$ and $i_2$ each indicate current flow and $R_1$, $R_2$, $R_3$ and $R_4$ each indicate resistance. Symbols (+) and (−) indicate the anode and cathode electrodes of the thyristor 20, respectively. The thyristor is brought in a conduction state when an overvoltage is applied between the electrodes of the thyristor.

Figure 7:
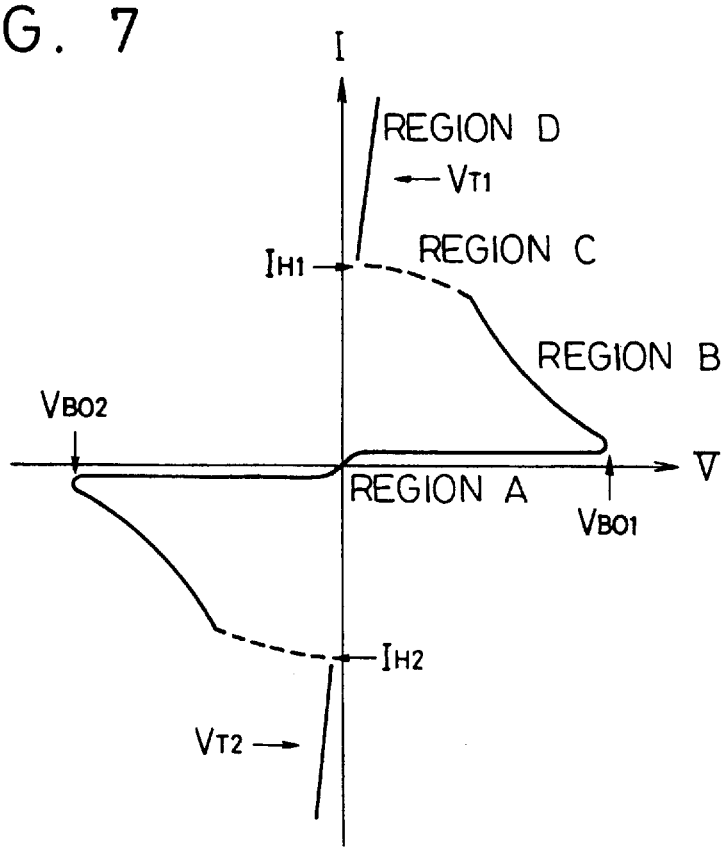
FIG. 7 is a graph showing the voltage V—current I characteristics of the bidirectional diode-thyristor.

The bidirectional diode-thyristor 20 has voltage V-current I characteristics as shown in FIG. 7. Specifically, when the applied voltage V to the thyristor 20 is low, the junction $J_2$ is kept in a reverse bias state, so that the thyristor 20 is kept in an off state (region A in FIG. 7). When the applied voltage V approaches the breakdown voltage of junction $J_2$, avalanche breakdown occurs at the junction $J_2$. When the applied voltage exceeds the breakover voltage $V_{BO}$ (suffixes "1" and "2" attached to the symbol in FIG. 7 indicate positive and negative, respectively), current $i_2$ flows just under the $P_1$ layer (region B), and a voltage drop ($i_2 \times R_2$) caused by the current $i_2$ is applied to the junction $J_2$. When the voltage drop reaches the diffusion potential of junction $J_2$, the injection of carrier from the $P_1$ layer to the $N_2$ layer starts, so that the flow of current $i_1$ takes place (region C). As a result, the sum of the current amplification factor of a transistor consisting of N2-P3-N4 layers having current dependency and the current amplification factor of a transistor consisting of P1-N2-P3 layers becomes "1", so that the thyristor 20 becomes in an on state. After the thyristor 20 becomes conductive, the on voltage $V_T$ appears which varies according to the forward voltage drop of PN junction diode (region D).

The above function of the thyristor 20 occurs in accordance with the polarity of voltage applied to the thyristor 20, and therefore the thyristor 20 shows the V-I characteristics of bipolar symmetry shown in FIG. 7.

Figure 8:
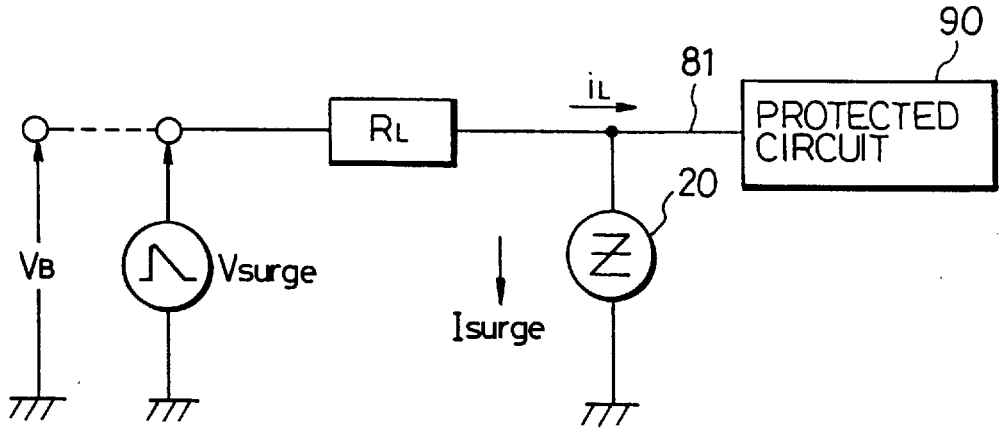
FIG. 8 is a view showing, by way of example, an overvoltage protection circuit using the bidirectional diode-thyristor.
Figure 9:
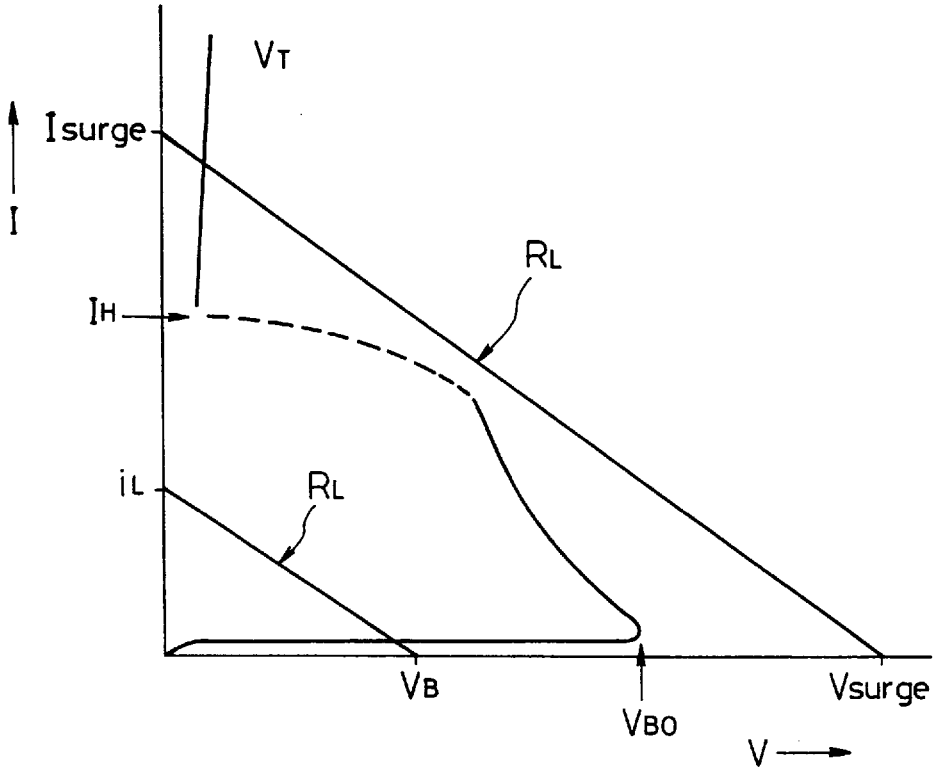
FIG. 9 is an operation characteristic diagram showing the overvoltage protection function of the bidirectional diode-thyristor in the circuit shown in FIG. 8.

As shown by way of example in FIG. 8, the bidirectional diode-thyristor 20 having the above-mentioned V-I characteristics is mounted at the stage preceding a protected circuit (data processing device) which is connected with a line 81 having a predetermined load $R_L$. As is apparent from the operating characteristic of the thyristor 20 shown in FIG. 9, during the normal operation in which a voltage $V_B$ lower than the breakover voltage $V_{BO}$ is applied to the line 81, the thyristor 20 is not conductive, and hence line current $i_L$ is supplied to the protected circuit 90 as it is.

In the case where an excessive surge voltage $V_{surge}$ caused by inductive lightning etc. is applied to the line 81, when the applied voltage V to the thyristor 20 exceeds the breakover voltage $V_{BO}$, the thyristor 20 conducts momentarily, so that the surge current $I_{surge}$ flows into the thyristor 20. At this time, the on voltage $V_T$ appears across the thyristor 20. Therefore, an excessive surge voltage $V_{surge}$ is not applied to the protected circuit 90. The surge current $I_{surge}$ decreases gradually, and when it reduces to the holding current $I_H$ (FIGS. 7 and 9) of the thyristor 20 or less, the thyristor is turned off, so that the aforementioned normal operation mode is restored.

Therefore, in the case where the signal-transmission cable 30 is connected with the modular socket 40 through the modular plug 1 provided with the thyristor 20 which has the aforementioned operating characteristic and which is interposed between the signal lines 33 of the signal-transmission cable 30 (line 81) extending from the data processing device 90, the thyristor 20 connected between the contact plates 15 is rendered conductive when the surge voltage $V_{surge}$ from the communication line 70 (FIG. 14) caused by inductive lightning etc. is applied between the contact plates 15 each of which is interposed between the socket contact 41 and the signal line 33 of the signal-transmission cable 30. Upon conduction of the thyristor 20, the surge current $I_{surge}$ which varies in dependence on the surge voltage $V_{surge}$ is bypassed to the thyristor 20. The voltage applied between the signal lines 33 of the signal-transmission cable 30 is kept at the voltage across the thyristor 20 (on voltage VT). Specifically, the surge voltage $V_{surge}$ applied between the contact plates 15 of the modular plug 1 from the communication line via the protector, interior wiring, and socket 40 is absorbed by the conduction of the thyristor 20. As a result, the surge voltage $V_{surge}$ is prevented from being applied to the data processing device via the signal-transmission cable 30, so that the data processing device can be protected effectively from the surge voltage $V_{surge}$.

The above-described modular plug 1 is convenient in that it can be used freely by the user. By using the plug 1, it is possible to prevent the surge voltage $V_{surge}$, applied via the communication line 70 from being propagated to the data processing device. Therefore, even if an overvoltage protection circuit consisting of a gas-tube arrester, zinc oxide varistor, etc. is not incorporated in the protector, the user can take protective measures against surge voltage easily and effectively. Specifically, even the ordinary user unqualified as electric worker can effectively protect the data processing device from a surge voltage caused by inductive lightning etc.

Figure 10:
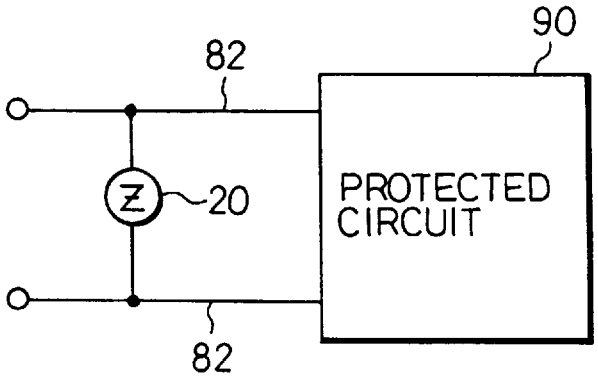
FIG. 10 is a view showing an example of basic application of the bidirectional diode-thyristor.
Figure 11:
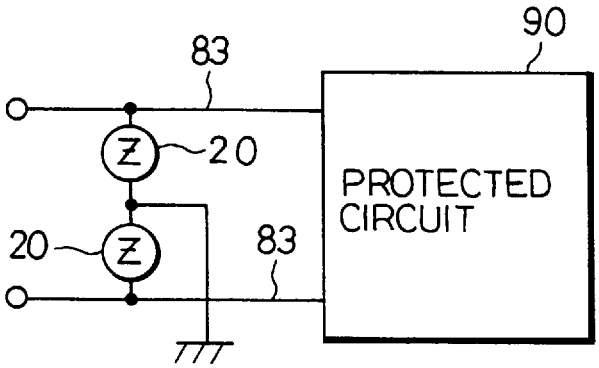
FIG. 11 is a view showing another example of application of the thyristor.

In the above embodiment, the connector device using the first signal-transmission cable and the second signal-transmission cable each consisting of two signal lines has been described. However, this invention is not limited thereto. For example, in the case of using the signal-transmission cable having many signal lines, in order to protect the protected device 90 from the surge voltage applied between a particular pair of signal lines among these signal lines, a thyristor 20 may be interposed between the particular paired signal lines 82, as shown in FIG. 10. To protect the protected device 90 from the surge voltage applied between each of signal lines and the ground line, two silicon bidirectional diode-thyristors 20 may be interposed in cascade between the paired lines 83, with the connection point of these thyristors 20 grounded, as shown in FIG. 11.

Next, a modular plug with overvoltage protection according to a second embodiment of the present invention will be described with reference to FIGS. 12 and 13.

The plug of this embodiment is characterized in that it can be assembled more easily. This plug has the same basic configuration as that of the first embodiment. In this regard, those elements which are the same as or similar to corresponding elements of the first embodiment will be described briefly and each of which is denoted by reference numeral equal to the sum of the reference numeral of a corresponding element of the first embodiment and "100".

A plug 101 includes a plug body 110, two first contact members 115, and a silicon bidirectional diode-thyristor 120. The plug body 110 has a plug section **110*a* adapted to be inserted into a modular Jack corresponding to the element 40 shown in FIG. 14 (hereinafter referred simply to as a modular jack 40). A lever 117 is integrally formed on the upper wall 110*e* of the plug body 110**.

The plug body 110 is formed with insertion holes 112 and 113 into which the distal end portion of a second signal-transmission cable 130 is inserted. The large-diameter insertion hole 112 is open to the rear end face of the plug body 110, and accommodates therein the distal end portion, covered with a sheath 131, of the signal-transmission cable 130. The two small-diameter insertion holes 113 communicate with the large-diameter insertion hole, and accommodate therein two bare conductor wires 133 at the distal end portion of the signal-transmission cable, respectively. In place of the two insertion holes 113, one insertion hole which collectively accommodates two conductor wires 133 may be provided. In a state where the signal-transmission cable 130 is inserted into the insertion holes 112 and 113, a part 111 of bottom wall of the plug body 110 is deformed by heating toward the cable 130 whereby the cable 130 is undetachably held in the insertion holes 112 and 113.

The plug body 110 is formed at its intermediate portion with a recess 110*b* whose lower face is open. The recess 110*b* is defined by the upper wall 110*e*, the front wall (plug section) 110*a*, and a partition wall 110*f* of the plug body 110. The partition wall 110*f* is formed with the insertion hole 113. The recess 110*b* communicates with the insertion hole 113. The plug section 110*a* is formed with two or more contact grooves 110*d* communicating with the recess 110*b*. Each contact groove 110*d* is open to the front and bottom faces of the plug section 110*a*.

Figure 14:
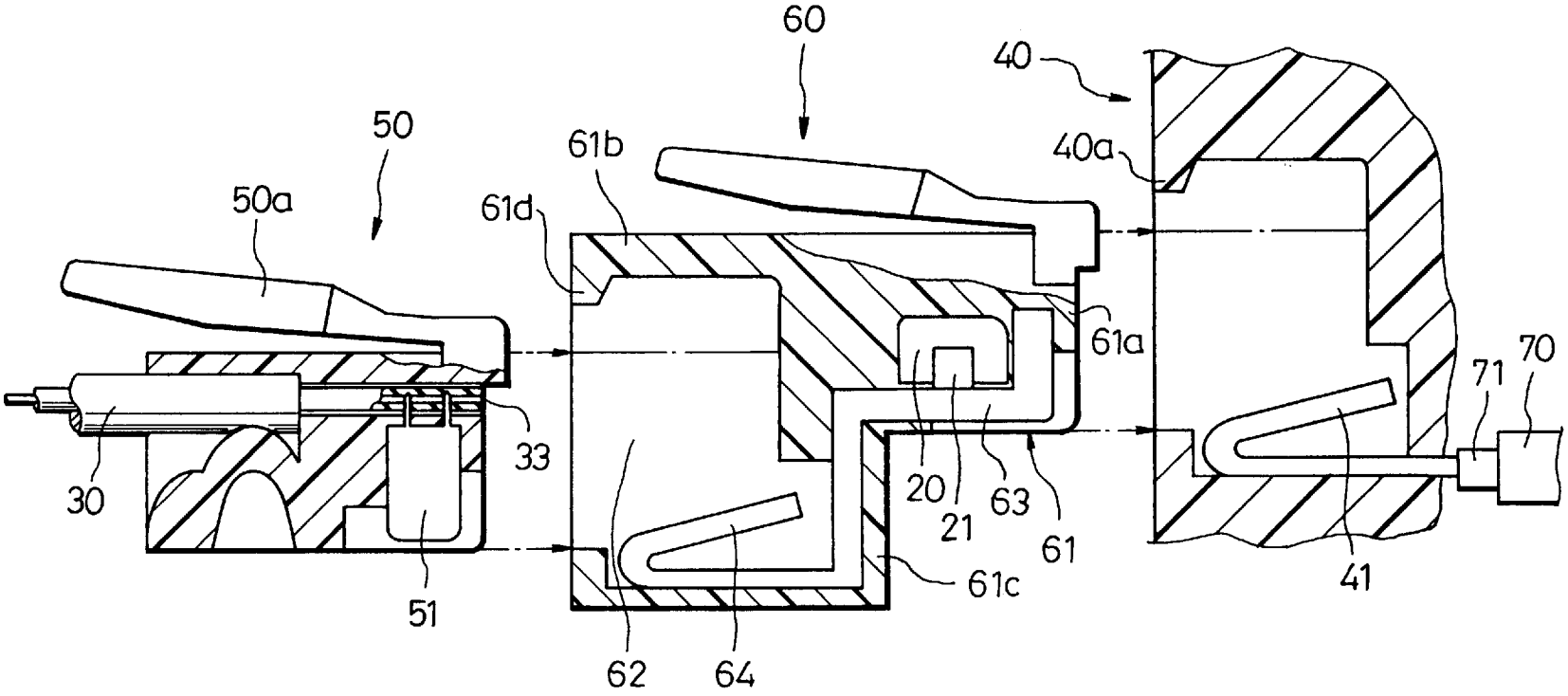
FIG. 14 is a longitudinal sectional view of an adapter with overvoltage protection according to a third embodiment of the present invention, together with an external modular socket and an external modular plug.

The recess 110*b* accommodates therein respective rear end portions 116*a* and intermediate portions 116*c* of wiring members 116 and the whole of the thyristor 120. Each of particular two contact grooves 110*d* receives therein an associated one contact member 115 and mainly a front end portion 116*b* of an associated one wiring member 116. The width of the contact groove 110*d* and the thickness of the contact member 115 and the wiring member 116, which are received in the contact groove, are slightly greater than the thickness of the socket contact 41 (FIG. 14). When the plug 101 is inserted into the socket 40, the contact member 115 comes in contact at its arcuate corner 115*d* with the socket contact 41, so that it is electrically connected with the conductor wire 71 of the signal-transmission cable (telephone line) via the socket contact 41.

Figure 12:
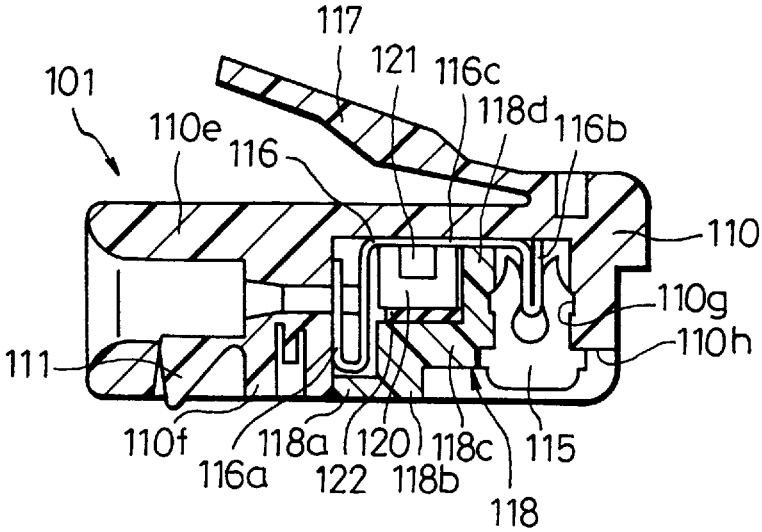
FIG. 12 is a longitudinal sectional view showing a modular plug with overvoltage protection according to a second embodiment of the present invention.
Figure 13:
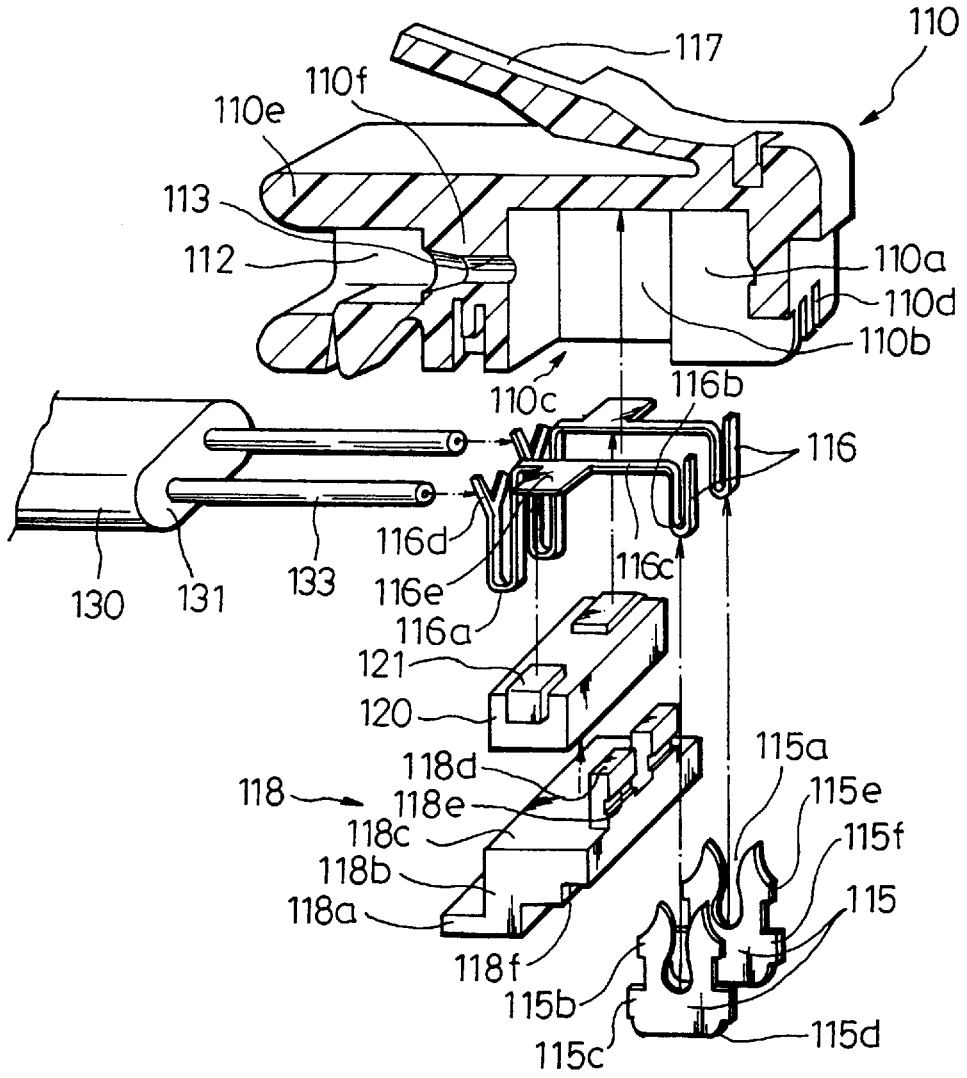
FIG. 13 is an exploded perspective view of the modular plug shown in FIG. 12.

Reference numeral 118 in FIGS. 12 and 13 denotes a lid member fitted to the recess 110*b*. The wiring body 116 and the thyristor 120 are held in the recess 110*b* by the lid member 118.

Specifically, each wiring member 116 which is made of a conductive metal plate is formed into an inverse U shape as a whole, as viewed in the longitudinal cross section of the plug, -and extends along the front end face of the partition wall 110*f*, the inner surface of the upper wall 110*e* and the rear end face of the front wall 110*a* of the plug body 110. The wiring member 116 has a U-shaped rear end portion 116*a* with spring property. The U-shaped rear end portion 116*a* consists of a first vertical section extending downward vertically from the intermediate portion 116*c*, a bent section, and a second vertical section extending upward vertically in parallel with the first vertical section. A tip end (first end) 116*d* of the second vertical section is formed into a Y shape, so that an associated one bare conductor wire 133, protruding from the insertion hole 113, of the signal-transmission cable 130 is held in the Y-shaped tip end 116*d*. The distal end portion of the conductor wire 133 has its outer peripheral surface disposed in contact with the Y-shaped tip end 116*d* of the wiring member 116. Preferably, the tip end face of the conductor wire 133 abuts on the rear face of the first vertical section of the U-shaped rear end portion 116*a* (FIG. 12). Thus, each conductor wire 133 and the associated wiring member 116 are electrically connected reliably to each other.

Each wiring member 116 has a U-shaped front end portion 116*b*, similar to the U-shaped rear end portion 116*a*, and the intermediate portion 116*c*. A vertical section of the U-shaped front end 116*b* has a length which is shorter than that of the rear end portion 116*a*. The tip end of the front end portion 116*b* is not formed into a Y shape.

The lid member 118 has a first horizontal section 118*a* extending horizontally along the opening 110*c* of the recess 110*b* just under the U-shaped rear end portion 116*a* of the wiring member 116, a first vertical section 118*b* extending vertically from the first horizontal section 118a to the thyristor 120 along the U-shaped rear end portion 116*a*, a second horizontal section 118*c* extending horizontally from the first vertical section 118*b* to the contact member 115 along the bottom surface of the thyristor 120, and a second vertical section 118*d* extending vertically from the second horizontal section 118*c* to the upper wall of the plug body 110 between the thyristor 120 and the contact member 115. That is, as viewed in the longitudinal cross section of the plug, the lid member 118 is formed into a staircase shape. The lid member 118 holds the wiring member 116 and the thyristor 120 in their places in the recess 110*b*, while it cooperates with the partition wall and the upper wall of the plug 110 to establish stable contact between the thyristor terminal 121 and a wide portion 116*e* which extends outward in the plug width direction from the intermediate portion 116*c* of the wiring member.

In FIG. 12, reference numeral 122 denotes a spacer which is disposed arbitrarily between the lid member 118 and the thyristor 120.

Each contact member 115 is provided at its center with a notch 115*a* whose upper end is open, and is formed into a U shape as a whole. The contact member is formed with engagement projections 115*b* and 115*c* at the rear edge thereof, and engagement projections 115*e* and 115*f* at the front edge thereof.

The central notch 115*a* of the contact members 115 receives a U-shaped front end portion of the associated wiring member 116. The engagement projections 115*b* and 115*c* of the contact member 115 engage with engagement recesses 118*e* and 118*f* formed on the front end face of the second vertical section 118*d* of the lid member 118, respectively. The engagement projection 115*e* of the contact member 115 engages with an engagement recess 110*g* formed on the inner face of the contact-groove-formed-portion of the plug section 110. Further, the engagement projection 115*f* engages with the bottom face 110*h* of the contact-groove-formed-portion of the plug section 110. With this arrangement, the wiring member 116 and the contact member 115 are connected with each other mechanically and electrically.

The wide portion 116*c* of each wiring member 116 comes in contact with an associated one exposed terminal 121 of the thyristor 120, so that the wiring member 116 is electrically connected with the thyristor terminal 121.

In assembling the plug 101 configured as described above, the distal end portion of the signal-transmission cable 130 whose outer sheath 131 of a predetermined length has been stripped is inserted into the insertion holes 112 and 113. The sheath-removed distal end portion of the cable is accommodated in the insertion hole 113, and the sheathed distal end portion of the cable is accommodated in the insertion hole 112. In this state, each wiring member 116 is inserted into the recess 110*b* of the plug body 110 through the recess opening 110*c*. At this time, the U-shaped front end portion 116*b* of the wiring member 116 is inserted into an associated one particular contact groove 110*d*. By arranging part of the wiring member 116 in the contact groove 110*d*, the wiring member 116 is disposed in the recess 110*b* of the plug body while it is positioned in place in the width direction of the plug.

Next, the thyristor 120 is mounted on the upper surface of the second horizontal section of the lid member 118 via the spacer 122, and the lid member 118 is fitted into the recess 110*b* of the plug body through the opening 110*c* and is fixed to the plug body 110. As a result, a pair of wiring members 116 are pressed against the inner surface of the upper wall 110*e* of the plug body 110 by the lid member 118 via the spacer 122 and the thyristor 120. Therefore, the U-shaped rear end portions 116*a* of the wiring members 116 are brought in contact with the two bare conductor wires 133, respectively, so that electrical connection between the wiring members 116 and the bare conductor wires 133 is established. Also, the two thyristor terminals 121 come in contact with the wide portions 116*e* of the wiring members 116, respectively, so that electrical connection between the thyristor terminals 121 and the wiring members 116 is established.

Next, the two contact members 115 are inserted into the particular two contact grooves 110*d*. As a result, the U-shaped front end portion 116*b* of each wiring member 116 fits in the central notch 115*a* of the corresponding contact member 115, and the engagement projections 115*b*, 115*c*, 115*e* and 115*f* of the contact member 115 engage with the engagement recesses 110*e*, 110*f* and 110*g* of the lid member 118 and the plug section 110 and the bottom face 110h of the plug section, respectively. As a result, the contact members 115 are held undetachably in the contact grooves 110*d*, and electrical connection between the contact members 115 and the wiring members 116 is established.

According to the plug 101 configured as described above, the assembly and electrical connection can be completed easily. That is, the electrical connection between the lead wire 130 and the contact members 115 and between the lead wire 130 and the thyristor 120 can be established surely by the mechanical contact/engagement provided between the aforementioned components of the plug 101, without the need of processing such as soldering. Moreover, part of each wiring member 116 and each contact member 115 are disposed in the corresponding contact groove 110*d*, and the contact members 115, the wiring members 116, and the thyristor 120 are held by the lid member 118 and the plug body 110. Further, the lead wire 130 is positioned and held stably in the insertion holes 112 and 113. With this arrangement, the elements 115, 116 and 120 can be positioned stably in the plug body 110, electrical connection between the elements 115, 116, 120 and 130 can be established stably, and very strong construction can be provided.

Next, a connector device according to a third embodiment of the present invention will be described with reference to FIG. 14.

The connector device of this embodiment is characterized in that it is suitable for use as an adapter which is interposed between a modular plug and a modular socket for establishing interconnection therebetween.

In FIG. 14, reference numeral 40 denotes a conventionally known modular socket (external connector socket). This socket 40 has socket contacts 41 electrically connected individually to, e.g., two signal lines 71 of the telephone line (first signal-transmission cable) 70 which is lead in the interior of a house. Reference numeral 50 denotes a conventionally known modular plug (external connector plug) attached to the distal end portion of a signal-transmission cable (second signal-transmission cable) 30 which extends from external electronic equipment such as a data processing device. This plug 50 has two plug contacts 51 electrically connected individually to two conductor wires of the signal-transmission cable 30. Reference numeral 60 denotes an adapter having an overvoltage protection function according to this embodiment.

The adapter 60 includes an adapter body 61. The adapter body 61 is provided at its front portion with a plug section 61a corresponding to the element 10*a* shown in FIG. 1, and is provided at its rear portion with a socket section 62 into which the modular plug 50 is detachably inserted. Specifically, at the rear side of the adapter body 61, a plug accommodation space (socket section 62) for accommodating therein the plug 50 is defined by an upper wall 61*b*, an L-shaped lower wall 61*c*, and opposite side walls (not shown) of the adapter body 61.

The adapter body 61 holds two first contact members 63, two second contact members 64, and a silicon bidirectional diode-thyristor 20. Each second contact member 64 is formed integrally with an associated one first contact member 63. To accommodate the elements 20, 63 and 64 in the adapter body 61, an upper half and a lower half of the adapter body 61 are fabricated separately, for instance. In this case, the upper and lower halves are joined to each other, with the thyristor 20 received in a thyristor accommodation recess formed in the upper half and the contact members 63 and 64 received in a contact member accommodation recess formed in the lower half.

The first contact members 63 each have a vertical section thereof extending downward along the front end face of the adapter body 61, and a horizontal section thereof extending rearward from the vertical section. The horizontal section has its upper face which is disposed in contact with a corresponding one thyristor terminal 21 exposed to the outside of the thyristor 20. The front portion of the L-shaped contact member 63 is disposed within an associated one of contact grooves which are formed in the plug section 61*a*. The second contact members 64 each have a vertical section thereof extending downward along the inner face of the vertical section of the L-shaped lower wall 61*c* of the adapter body 61 from the rear end of the horizontal section of the associated first contact member 63, a horizontal section thereof extending rearward along the inner face of the horizontal section of the L-shaped lower wall 61*c* from the vertical section, and a contact section thereof extending upward obliquely from the horizontal section toward the front portion of the adapter body. The contact section has a spring property.

When the plug section 61*a* of the adapter 60 is inserted into the external socket 40, the two first contact members 63 of the adapter 60 are electrically connected with the two socket contacts 41 of the socket 40. When the external plug 50 is inserted into the socket section 62 of the adapter 60, the two plug contacts 51 of the plug 50 are electrically connected with the two second contact members 64 of the adapter 60. Thus, the two conductor wires 33 of the signal-transmission cable 30 extending from a data processing device etc. are electrically connected with the two conductor wires 71 of the telephone line 70 via the plug 50, the adapter 60, and the socket 40. That is, the adapter 60 has a function of electrically interconnecting the socket contact 41 and the plug contact 51. In FIG. 14, reference numeral 61 denotes an engagement projection which is provided at the upper edge of opening on the rear end face of the adapter body 61. This engagement projection 61*d* engages with a shoulder of a lever 50*a* of the plug 50 when the plug is inserted into the adapter 60, to thereby detachably hold the plug 50 in the socket section 62.

If an overvoltage is applied between a pair of contact members 63 of the adapter 60 via the telephone line 70, the silicon bidirectional diode-thyristor 20 interposed between the contact members 63 is rendered conductive to absorb the overvoltage.

According to the adapter 60 configured as describe above, the existing modular plug 50, attached to the distal end of the signal-transmission cable 30 extending from a data processing device, is connected through the adapter 60 with the existing modular socket 40 that is originally devised for exclusive use with the plug 50. Simply by doing this, if a surge voltage (corresponding to $V_{surge}$ in FIG. 9) caused by inductive lightning is applied to the socket 40 through the communication line 70, the surge voltage is absorbed by the thyristor 20 of the adapter 60. As a result, the surge voltage is prevented from being propagated to the plug 50, and in turn, to the data processing device via the signal-transmission cable 30. Therefore, the data processing device can be protected from the surge voltage effectively. Moreover, the adapter 60 can be interposed easily by the user between the socket 40 and the plug 50, so that preventive measures against surge voltage can be taken.

Next, a connector device with overvoltage protection according to a fourth embodiment of the present invention will be described with reference to FIG. 15.

The connector device of this embodiment is common to that of the third embodiment in that it is configured in the form of modular adapter having a function of overvoltage protection, and common to that of the second embodiment in that wiring members are employed for easy assembly of the connector device.

Figure 15:
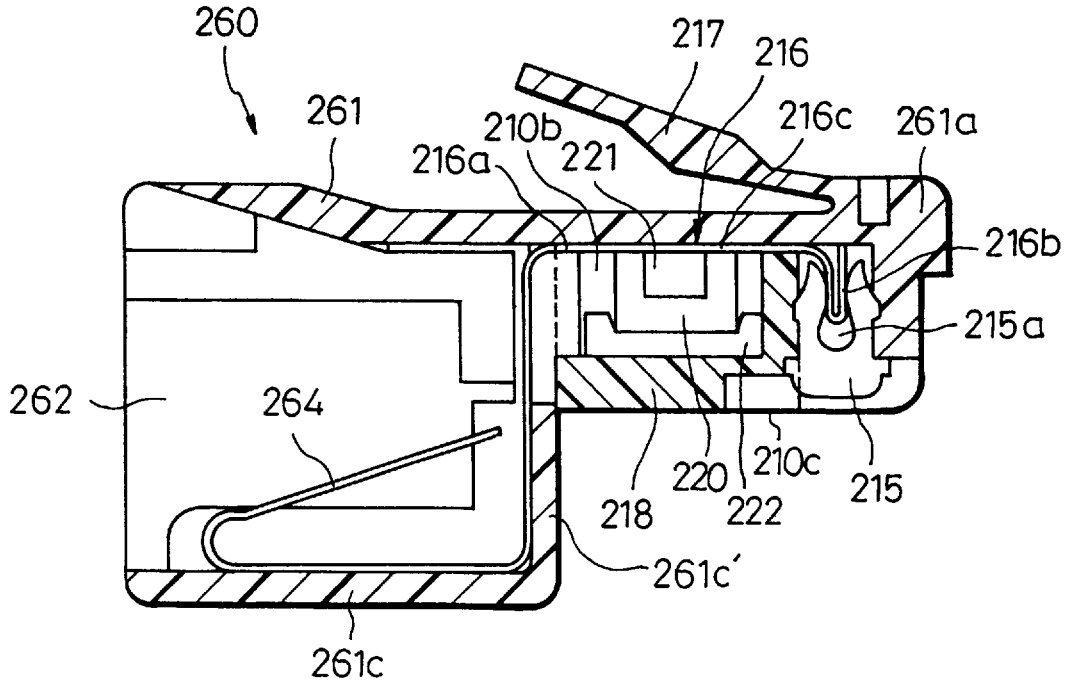
FIG. 15 is a longitudinal sectional view of an adapter according to a fourth embodiment of the present invention.

Therefore, those elements which are the same as or similar to the elements shown in FIGS. 12, 13 and 14 relating to the second and third embodiments are denoted by like numerals in FIG. 15. The following is a brief description of an adapter of this embodiment.

Referring to FIG. 15, an adapter body 261 of an adapter 260 includes a plug section 210*a* thereof adapted to be inserted into an external modular socket (corresponding to the socket 40 in FIG. 14) and a modular socket section 262 thereof adapted to receive an external modular plug (corresponding to the plug 50 in FIG. 14).

The adapter body 261 cooperates with a lid member 218 to hold therein a silicon bidirectional diode-thyristor 220, two first contact members 215, and two wiring members 216. The lid member 218 has a horizontal section thereof extending in the longitudinal direction of the adapter along an opening of a recess 210*b* of the adapter body 261 and a vertical section thereof extending in the height direction of the adapter between the thyristor 220 and the first contact member 215. The horizontal section of the lid member 218 supports a spacer 222, the thyristor 220, and the wiring member 216 in cooperation with the adapter body 261, while the vertical section of the lid member 218 supports the first contact member 215 and the wiring member 216 in cooperation with the adapter body 261.

The wiring members 216 each have a rear end portion 216*a* thereof extending horizontally in the longitudinal direction of the adapter, a U-shaped front end portion 216*b* thereof fitted in a central notch 215*a* formed in a corresponding one first contact member 215, and an intermediate portion 216*c* thereof disposed in contact with an associated one terminal of the thyristor 220. Each second contact member 264 is formed integrally with an associated one wiring member 216. The connecting portion between the wiring member 216 and the contact member 264 extends from the recess 210*b* of the adapter 260 into the socket section 262 via an opening formed at the upper half portion of a partition wall 261*c'* (corresponding to the vertical section of the lower wall 61c of the adapter body shown in FIG. 14) of the adapter body 261. The second contact members 261*c* each have a vertical section thereof extending along the partition wall 261*c'*, a horizontal section thereof extending along the inner surface of the lower wall 261*c* of the adapter body, and a contact section thereof extending upward obliquely from the horizontal section toward the front portion of the adapter body. The horizontal section has a spring property.

In order to assemble the wiring members 216 into the adapter body 261, the wiring members 216 are inserted in the longitudinal direction of the adapter toward the socket section 262 and the recess 210*b* of the adapter body through the rear end opening of the adapter body. After the wiring members 216 are inserted into the adapter body, the thyristor 220 and the spacer 222 are disposed within the recess 210*b*, and the lid member 218 is fitted in the opening 210*c* of the recess 210*b* to thereby retain these elements 220 and 222. Then, the contact members 215 are mounted between the lid member 218 and the front wall of the adapter body 261, thereby completing the assembly of the adapter 260.

Other configuration and effects of the adapter 260 are the same as those of the devices of the second and third embodiments, so that the explanation is omitted.

According to the adapter 260 configured as described above, by merely mounting the adapter 260 between the existing modular plug and the existing modular socket, a surge voltage caused by inductive lightning and applied from a communication line can be absorbed effectively by the thyristor 220 incorporated in the adapter 260. That is, by merely mounting the adapter 260 on the communication signal line for a data processing device, especially at the connecting portion between the modular socket and the modular plug, the data processing device can be protected from the surge voltage easily and effectively.

Moreover, since the wiring members 216 and the contact members 264 are integral with each other in this adapter 260, the entire construction of the adapter can be simplified, and the number of its component parts can be reduced.

Figure 16:
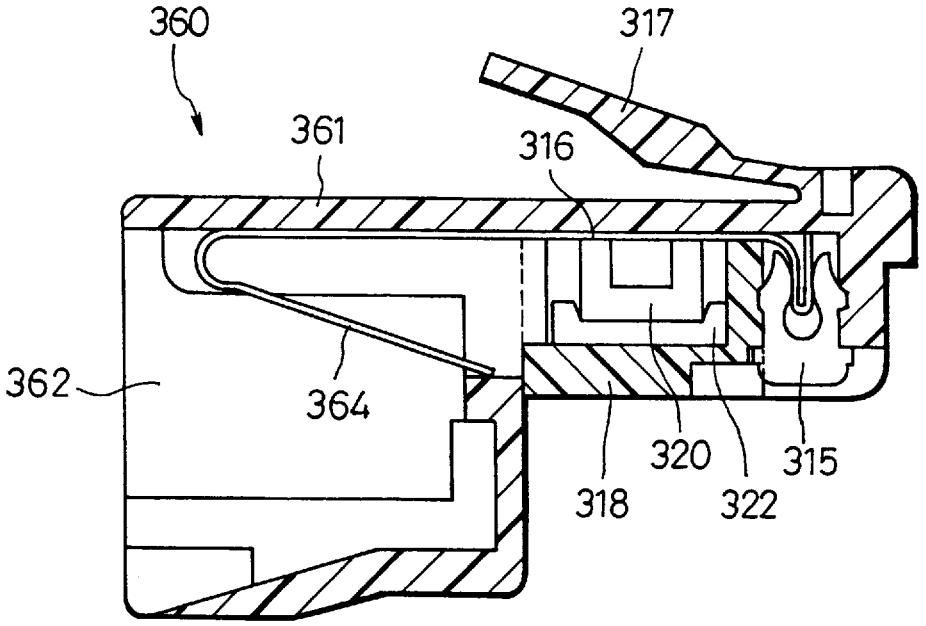
FIG. 16 is a sectional view showing a modification of the adapter shown in FIG. 15.

FIG. 16 shows a modification of the adapter 260 shown in FIG. 15.

An adapter 360 shown in FIG. 16 differs from the adapter 260 shown in FIG. 15 in that the external modular plug is disposed in an inverted position when inserted into the socket section of the adapter. Regarding this difference, each second contact member 364 consists of a horizontal section thereof extending rearward in the longitudinal direction of the adapter from the rear end of a corresponding one wiring member 316 along the upper wall inner surface of an adapter body 361, and a contact section thereof extending downward obliquely from the horizontal section toward the front portion of the adapter.

Other configuration and effects of the adapter 360 are the same as those of the adapter 260 shown in FIG. 15, so that the explanation is omitted.

The present invention is not limited to the first to fourth embodiments and the aforementioned modification.

For example, in each of the first to fourth embodiments, the modular plug 1 or 101 or the adapter 60 or 260 with overvoltage protection is adapted to be inserted into the modular socket 40 provided on the wall surface of house. However, the plug 1 or 101 or the adapter 60 may be adapted to be inserted into a socket provided on the data processing device. In this case as well, overvoltage is absorbed by the silicon bidirectional diode-thyristor 20 incorporated in the plug or adapter, thereby preventing the propagation of surge voltage to the data processing device via the socket of the device.

In the above embodiments, the examples in which the present invention is applied to a modular type connector have been described. However, the present invention is also applicable to other connector constructions in a similar manner. Further, the number of connection terminals in the connector is not especially limited. When the connector has three or more connection terminals (signal lines), a bidirectional diode-thyristor should be interposed between the connection terminals to which a surge voltage is likely applied. In this case, for those wiring members which need not be connected with the thyristor 20, no wide intermediate portions are formed, to thereby prevent the wiring members from contacting with the terminal 21 of the thyristor 20.

The adapter of the present invention may have shape, dimensions, etc. thereof determined so as to conform to the FCC standard.

The constructional features of the first to fourth embodiments can be combined variously. For example, the device shown in FIG. L, which uses the second signal-transmission cable comprised of sheathed conductor wires, may be modified so that the cable comprised of bare conductor wires as shown in FIG. 13 can be used. Inversely, the devices shown in FIGS. 12 and 13 may be modified so that the cable comprised of sheathed conductor wires can be used.

The present invention can be modified variously without departing from the spirit and scope thereof.

What is claims is:

1. A connector device with overvoltage protection, comprising:

a main body having a plug section adapted to be detachably inserted into a modular jack which has two socket contacts electrically connected individually to two conductor wires of a first signal-transmission cable;

two first contact members disposed in said plug section and electrically connected individually to said two socket contacts when said plug section is inserted into said modular jack, said two first contact members being connected or adapted to be connected respectively to two conductor wires of a modular cable of a second signal-transmission cable which is connected or adapted to be connected with external electronic equipment;

wherein each of said two conductor wires of said modular cable includes an insulator which covers the respective conductor wire, and wherein each of said first contact members has a contact pin which breaks said insulator and comes in contact with a respective one of said conductor wires; and an overvoltage absorption solid-state device disposed in said main body and having two terminals which are electrically connected individually to said two first contact members.

2. A connector device according to claim 1, wherein said overvoltage absorption solid-state device comprises a silicon bidirectional diode-thyristor.

3. A connector device according to claim 1, wherein said main body is formed with a cable accommodation space for accommodating therein one end portion of said modular cable.

4. A connector device according to claim 1, wherein said two conductor wires of the second signal-transmission cable are covered by a common sheath.

5. A conductor device according to claim 4, wherein said connector device includes said modular cable.

6. A connector device according to claim 3, wherein said main body has an end face disposed on a side remote from said plug section;

said modular cable has a sheath for sheathing said two conductor wires; and said cable accommodation space has a first space section which is open to said end face of said main body and accommodates therein said modular cable with the sheath and a second space section which communicates with said first space section and accommodates therein said modular cable with the sheath stripped therefrom.

7. A connector device according to claim 1, wherein said plug section of said main body is formed with two grooves, and each of said grooves accommodates therein an associated one of said two first contact members.

8. A connector device according to claim 7,wherein said two first contact members are arranged adjacently to said overvoltage absorption solid-state device, and each of said first contact members has a portion thereof disposed in contact with a corresponding one of said two terminals of said overvoltage absorption solid-state device at the outside of said two grooves.

9. A connector device according to claim 1, wherein said main body is formed with a recess for accommodating therein said overvoltage absorption solid-state device;

said two terminals of said overvoltage absorption solid-state device are exposed from an outer face of said solid-state device;

said connector device further includes a pair of wiring members;

at least part of each of said wiring members is disposed in said recess of said main body; and each of said wiring members has a first end thereof electrically connected with an associated one of said two conductor wires of said modular cable, a second end thereof disposed in contact with an associated one of said two first contact members, and an intermediate portion thereof disposed in contact with an associated one of said two terminals of said overvoltage absorption solid-state device.

10. A connector device according to claim 9, wherein said modular cable has a sheath for sheathing said two conductor wires;

said main body is formed with a cable accommodation space for accommodating therein one end portion of said modular cable;

said cable accommodation space communicates with said recess;

said two seconds conductor wires of said modular cable protrude from said cable accommodation space into said recess; and said first end of said each wiring member is disposed in contact with an associated one of said two bare conductor wires of said second signal-transmission cable which protrude into said recess.

11. A connector device according to claim 9, wherein said recess of said main body has an opening which opens to one of those external surfaces of said main body which extend in a longitudinal direction of the main body;

said wiring members are disposed in said recess on a side remote from said opening of said recess as viewed in a height direction of said main body;

said overvoltage absorption solid-state device is disposed adjacently to said wiring members as viewed in the height direction of said main body in said recess;

said connector device further includes a lid member which closes at least part of said opening of said recess; and said lid member cooperates with said main body to hold said wiring members, said overvoltage absorption solid-state device, and said two first contact members.

12. A connector device according to claim 11, wherein said plug section of said main body is formed with two grooves;

said recess is adjacent to said plug section in the longitudinal direction of said main body and communicates with said two grooves of said plug section;

each of said grooves accommodates therein an associated one of said two first contact members and part of an associated one of said wiring members;

said lid member has a longitudinal lid section thereof extending in the longitudinal direction of said main body along said opening of said recess, and a vertical lid section thereof extending in the height direction of said main body between said overvoltage absorption solid-state device and said two first contact members;

said main body has a wall thereof disposed on the side remote from said opening of said recess, as viewed in the longitudinal direction of said main body;

said wall cooperates with said plug section to define said recess, and cooperates with said longitudinal lid section of said lid member to hold said wiring members and said overvoltage absorption solid-state device; and said plug section cooperates with said vertical lid section of said lid member to hold said two first contact members.

13. A connector device according to claim 12, wherein each of said first contact members is formed at its opposite edges with one or more engagement projections or engagement recesses; and each of said plug section and said vertical lid section is formed with one or more engagement recesses or engagement projections with which said associated one or more engagement projections or engagement recesses engage.

14. A connector device according to claim 1, wherein said main body is formed with a socket section adapted to detachably receive an external connector plug, said connector plug having two plug contacts electrically connected individually to said two conductor wires of said modular cable;

said connector device further includes two second contact members disposed in said socket section;

said two second contact members are electrically connected with said two first contact members, respectively; and said two second contact members are electrically connected with said two plug contacts, respectively, when said external connector plug is inserted into said socket section.

15. A connector device according to claim 14, wherein said external connector plug is a modular plug; and said socket section is adapted to detachably receive said modular plug.

16. A connector device according to claim 14, wherein said main body is formed with a recess for accommodating therein said overvoltage absorption solid-state device;

said two terminals of said overvoltage absorption solid-state device are exposed from an outer face of said solid-state device;

said connector device further includes a pair of wiring members disposed in said recess of said main body; and each of said wiring members has a first end thereof electrically connected with an associated one of said two second contact members, a second end thereof disposed in contact with an associated one of said two first contact members, and an intermediate portion thereof disposed in contact with an associated one of said two terminals of said overvoltage absorption solid-state device.

17. A connector device according to claim 16, wherein said recess communicates with said socket section; and each of said second contact members is formed integrally with an associated one of said wiring members.

18. A connector device according to claim 17, wherein said recess of said main body has an opening which opens to one of those external surfaces of the main body which extend in a longitudinal direction of the main body;

said wiring members are disposed in said recess on a side remote from said opening of said recess as viewed in a height direction of said main body;

said overvoltage absorption solid-state device is disposed adjacently to said wiring members in said recess as viewed in the height direction of said main body;

said connector device further includes a lid member which closes at least part of said opening of said recess; and said lid member cooperates with said main body to hold said wiring members, said overvoltage absorption solid-state device, and said two first contact members.

19. A conductor device according to claim 5, wherein said connector device includes said second signal-transmission cable; and each of said first contact members is in contact with an associated one conductor of said conductor wires of said second signal-transmission cable.

* * * * *

UNITED STATES PATENT AND TRADEMARK OFFICE

CERTIFICATE OF CORRECTION

PATENT NO. : 5,846,099

DATED : December 8, 1998

INVENTOR(S) : HIRUMA et al

It is certified that error appears in the above-identified patent and that said Letters Patent is hereby corrected as shown below:

Column 18, line 53 (claim 10, line 13), delete "bare";

Column 18, line 54 (claim 10, line 14), change "second signal-transmission" to --modular--.

Signed and Sealed this

Fourteenth Day of March, 2000

*Attest:*

*Attesting Officer*

Q. TODD DICKINSON

*Commissioner of Patents and Trademarks*